US005992575A

United States Patent [19]

Kim

[11] Patent Number: 5,992,575

[45] Date of Patent: Nov. 30, 1999

[54] PERSONAL RAPID TRANSIT BRAKING SYSTEMS

[76] Inventor: In Ki Kim, 32-202 Hyosung Villa, #64 Chungdam-dong, Kangnam-ku Seoul 135-100, Rep. of Korea

[21] Appl. No.: 08/952,654

[22] PCT Filed: Mar. 24, 1997

[86] PCT No.: PCT/KR97/00044

§ 371 Date: Jan. 30, 1998

§ 102(e) Date: Jan. 30, 1998

[87] PCT Pub. No.: WO97/35757

PCT Pub. Date: Oct. 2, 1997

[30] Foreign Application Priority Data

Mar. 23, 1996 [KR] Rep. of Korea ..... 96-8040

[51] Int. Cl.[6] ..... B61H 7/00

[52] U.S. Cl. ..... 188/38; 104/139; 188/41

[58] Field of Search ..... 188/38, 41, 62, 188/42, 43, 44, 56; 104/139

[56] References Cited

U.S. PATENT DOCUMENTS

| | | | |
|---|---|---|---|
| 2,285,327 | 6/1942 | Brown | 188/62 |
| 3,096,854 | 7/1963 | Price | 188/42 |
| 3,330,384 | 7/1967 | Bertin | 188/38 |
| 3,646,613 | 2/1972 | Matsumoto et al. | 104/295 |
| 3,791,308 | 2/1974 | Hartz | 104/139 |
| 3,869,990 | 3/1975 | Bertling | 104/130.02 |
| 3,874,299 | 4/1975 | Silva et al. | 104/30.02 |
| 3,882,788 | 5/1975 | Simon et al. | 104/286 |
| 3,882,790 | 5/1975 | Winkle et al. | 104/286 |
| 3,901,160 | 8/1975 | Auer et al. | 104/130.07 |
| 3,931,767 | 1/1976 | Karch | 104/130.02 |
| 4,061,089 | 12/1977 | Sawyer | 104/23.2 |
| 4,665,830 | 5/1987 | Anderson et al. | 104/124 |
| 4,671,185 | 6/1987 | Anderson et al. | 104/130.07 |
| 4,766,547 | 8/1988 | Modery et al. | 104/88.04 |
| 4,819,564 | 4/1989 | Brandis et al. | 104/292 |
| 4,987,834 | 1/1991 | Peck, Jr. et al. | 104/300 |
| 5,033,394 | 7/1991 | Summa | 104/307 |
| 5,108,052 | 4/1992 | Malewicki et al. | 246/5 |
| 5,138,952 | 8/1992 | Low | 104/139 |
| 5,778,796 | 7/1998 | Kim | 104/139 |

FOREIGN PATENT DOCUMENTS

| | | |
|---|---|---|
| 242177 | 10/1987 | European Pat. Off. . |
| 2150245 | 4/1973 | Germany . |
| 2420245 | 10/1975 | Germany . |
| WO95/35221 | 12/1995 | WIPO . |

OTHER PUBLICATIONS

*Physics*, "Faraday's Law of Induction," David Halliday and Robert Resnick, pp. 770–774, 1960.

*Primary Examiner*—Robert J. Oberleitner
*Assistant Examiner*—Hargobind S. Sawhney
*Attorney, Agent, or Firm*—Stevens, Davis, Miller & Mosher, L.L.P.

[57] ABSTRACT

The present invention relates to a Personal Rapid Transit system for transporting passengers along a pre-set guideway, and more particularly relates to a future Personal Rapid Transit vehicle braking system. A conventional braking system can not provide the large braking force required for very short headway operation under the effect of weather and environmental conditions due to variations in the available coefficients of friction at the running surfaces. In particular, the Personal Rapid Transit which is a public transportation system can not adopt the conventional braking system since the vehicles are powered by linear motors and are independent of traction. The PRT brake system comprises brake reaction rails (120) mounted on each inside of the guideway and brakes (300) acting on these brake reaction rails (120) as calipers. The brakes are automatically actuated when electric power supply is cut off, and thus can serve as parking brakes and emergency brakes. Since the braking system of the present invention is supplied with power via the strain energy stored in steel spring members, no external power source for its operation is required. Furthermore, the system comprises a redundant failure monitored brake releasing unit (380) which is driven by duplicate redundant electric motors. Accordingly, the PRT braking system of the present invention represents a highly efficient fail-safe parking or emergency brake.

20 Claims, 14 Drawing Sheets

PERSONAL RAPID TRANSIT BRAKING SYSTEMS

TECHNICAL FIELD

The present invention relates to a Personal Rapid Transit system for transporting passengers along a pre-set elevated guideway which carries small three seat personal vehicles non-stop from origin station to destination station. More particularly this invention relates to the unique requirements of the Personal Rapid Transit braking system.

BACKGROUND ART

Personal Rapid Transit (Hereinafter referred to as PRT) is a public transportation system which provides passengers a non-stop trip from origin to destination in a small personal vehicle. The vehicles are fully automated and run on a small light weight aerial guideway which can be located above streets, through buildings etc. The PRT system provides a high transportation capacity by operating the vehicles at very short headways of about 0.5 seconds. This provides a practical capacity of about 6000 vehicles per hour on a single guideway.

In order to operate safely at these headways, each vehicle is equipped with a sophisticated computer control system which varies the thrust of the linear induction motors to provide acceleration and braking. Under normal operating conditions braking of moving vehicles will be accomplished by reversing the thrust direction of the linear motors.

However, when the vehicle stops at a station to unload and load passengers and when the vehicle is parked in storage, the separate parking brake must be applied. When there is any malfunction in a vehicle or failure of the power supply of a moving vehicle which may lead to a dangerous situation, it will be necessary to apply the emergency brake.

Conventional braking system mechanisms for wheeled vehicles are well known, but are not applicable for PRT. These systems consist of a body mounted mechanism which applies a frictional device to the rotating parts of the wheel assembly. Deceleration is accomplished by reducing the speed of rotation of the wheel which thus transmits the braking force to the running surface.

Some vehicles achieve braking by applying a brake shoe to the guideway surface or track. These vehicles rely on an electromagnetic force to apply the brake shoe to the track rail, but the operation of the brake shoe necessarily requires an external electric power source.

Other types of guideway brakes apply a mechanically operated brake shoe to the rail or running surface, and the braking force in this case depends upon the weight of the vehicle and the coefficient of friction between the brake shoe and the running surface. This coefficient is generally in the range of 0.3 to 0.7 in dry weather conditions, but it can be reduced to a small fraction of that coefficient under adverse weather conditions such as snow, ice or rain.

The PRT vehicles are propelled by the thrust generated by a linear induction motor which acts against a reaction rail mounted on the guideway. Normally, there is no mechanical contact between the linear induction motor and the reaction rail. The PRT vehicles wheels simply provide support and guidance to the vehicles. The wheels are not required to transmit propulsion torque nor provide adequate braking because they are smooth tired and run on a smooth stainless steel guideway lubricated to reduce rolling resistance.

This means that a conventional braking system can not be used in this PRT system, thus a separate braking system which can serve as a parking brake as well as an emergency brake is required. This brake must be able to operate in the absence of electric power.

DISCLOSURE OF INVENTION

In order to solve the above adhesion problems, the objective of the present invention is to provide a braking system for the PRT vehicles which will be unaffected by weather and other environmental conditions, can provide large emergency braking force regardless of the weight of the vehicles, and can be automatically actuated without any commands in the event that electric power is cut off. The brake system should also be redundant and failure monitored for high reliability.

To accomplish the above objective, a braking design system has been developed for Personal Rapid Transit vehicles consisting of a guideway element disposed along a predetermined path fitted with a brake reaction rail against which the vehicles will apply braking force and a vehicle mounted parking and emergency brake which will act against the guideway brake reaction rail comprising:

- steel box section brake reaction rails aligned along both inner sides of the guideway against which the parking/emergency brakes will act;
- a brake mechanism mounted to the rear end of each vehicle consisting of a steel frame on which are mounted the brake arms, mounting linkages, brake actuator shafts, actuator springs, brake. triggers, trigger solenoids, redundant brake release motors, reduction gear trains, and other components described in detail below;
- brake actuator shafts installed at each side of the vehicle normal to the axial direction;
- brake actuator links, mounted on the brake frame and disposed opposite to each other, being connected to the actuator shafts and composed of pairs of links which rotate from the normal 'off' position to a predetermined angle in the 'on' position according to the forward or backward movement of the actuator shafts;
- a pair of brake arms, fitted with high friction coefficient
- brake pads, connected to each pair of brake links and installed in a caliper type arrangement so that the lateral position and clearance of the brake pads contacting each side of the brake rails can be varied according to the rotational angle of the links, thereby providing the braking force;
- a trigger unit for holding the actuator shafts at a constant 'off' position or releasing the actuator shafts when braking is necessary;
- spring members placed in tension for elastically powering the actuator shafts held in the 'off' position by the trigger unit, and for moving the actuator shafts in the predetermined direction to the 'on' position for brake operation when the actuator shafts are released from the trigger unit;
- a pair of redundant and failure monitored electric motors providing power for releasing the brake unit by moving the actuator shafts in the reverse direction to the 'off' position and thereby releasing the 'brakes-on' condition.
- a gear train for transmitting the torque of the brake release motors to the actuator shafts in which the gear are intermeshed so that if necessary one motor can power the entire brake release mechanism.

BRIEF DESCRIPTION OF DRAWINGS

FIG. 4A shows the brake off and FIG. 4B shows the brake on.

BEST MODE FOR CARRYING OUT THE INVENTION

The preferred embodiment of a brake system for personal rapid transit in accordance with the present invention will be described in detail with reference to the accompanying drawings.

Figure 1:
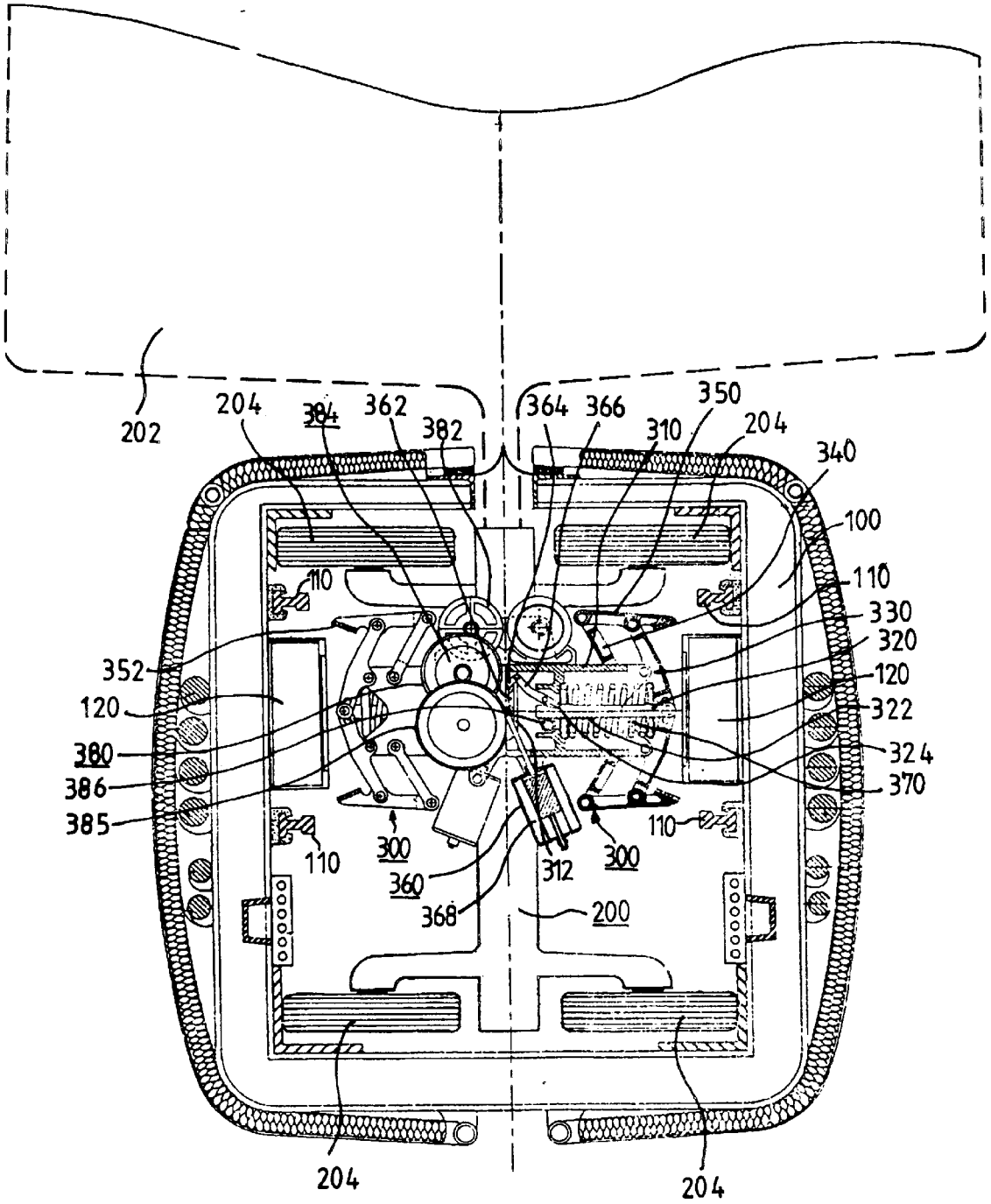
FIG. 1 is a cross-sectional view showing a vehicle chassis in a single guideway with the brakes in a released position.

FIG. 1 is a cross-sectional view showing a vehicle chassis in a single guideway with the brakes in a released position. A guideway 100 is shown in FIG.1, at the inside of which a vehicle chassis 200 running along the guideway 100 is disposed. The vehicle chassis 200 is connected with a passenger cabin 202 on the top of the guideway 100.

The guideway 100 has an approximately quadrilateral shape having a vacancy in which the vehicle chassis 200 can be accommodated. Electric power supply rails 110 are disposed at predetermined intervals on top and bottom of both lateral insides of the guideway 100. Brake reaction rails 120 which are projected inwards are positioned between the electric supply rails 110. The top and bottom surfaces of the brake reaction rails 120 are roughened to have high coefficients of friction on the parts where the brakes are actuated.

The vehicle chassis 200 is equipped with guidance wheels 204 and support wheels 205 (shown in FIG. 2) which have no function for propelling the chassis 200 and do not transmit the braking force to their contact surfaces. These wheels 204 just laterally support and guide the running chassis 200. The vertical support wheels 205 also transmit no torque or braking force.

The chassis 200 is linked to the brake support frame 310 for installing brakes 300. A pair of brakes 300 are mounted on each side of the support frame 310 in opposition to each other. This arrangement is intended to activate the brakes on both the top and bottom sides of the brake reaction rails 120. The inner structure of both lateral brakes 300 is the same and they are also disposed in opposition to each other. FIG. 1 shows a cross-sectional view of the right hand side of the brake 300 and an exterior view of the left hand side of the brake 300.

The brake actuator shafts 320, which can be moved forward and backward in the lateral axis direction, are installed inside the support frame 310. On the underside of the actuator shafts 320 a rack gear 322 is machined. On the upper side of the actuator shafts 320 a groove 324 is machined to hold the brake trigger 366. At the outer ends of the actuator shafts 320, a pair of links 330 are connected. These links are pin jointed to the frame 310 and connected to the brake arms 350 by pinned joints. A second pair of links 340 which are located apart from the first links 330 at a predetermined interval, are pin jointed to the brake frame 310 and connected by pinned joints to the brake arms 350. The first pair of links 330 and the second pair of links 340 are arranged in an asymmetrical quadrilateral shape with the brake arms 350. The geometry of this quadrilateral arrangement allows the brake arms 350 to move outwards and to move vertically towards each other as they come between the electric power supply rails 110 and the brake reaction rails 120. If the brake arms were actuated by a simple swing arm linkage the brake pads would have fouled the electric power rails.

The brakes are activated by moving the actuator shaft 320 inwards towards the centerline of the chassis 200 and they are deactivated by moving the actuator shaft 320 outwards towards the sides of the guideway 100.

On each side of the brake 300, the upper and lower brake arms 350 which are connected to the first described links 330, and the second described links 340 are disposed opposite to each other thus forming a caliper mechanism. The location and clearance of the brake pads 352 at the ends of the brake arms can be varied according to the rotational angle of the links 330 and 340. The pair of brake arms 350 provide the braking force by bringing the brake pads 352 into contact as calipers against the brake reaction rails 120. The brake pads 352 are attached to the end of the brake arms 350. The brake pads 352 are made of a sintered carbon composite compound or an asbestos compound, etc. having high coefficients of friction.

The support frame 310 is equipped with duplicate solenoid actuated trigger units 360 for holding or releasing the brake actuator shafts 320 according to necessity. The trigger units 360 are comprised of solenoids 368 which actuate shafts connected to a vertically mounted trigger actuation link 362 which is movably installed perpendicular to the actuator shafts 320 within a guidance unit 312 formed on the inside of the support frame 310. A pair of rotational compensation links 364 are installed to connect the trigger actuator link 362 to the triggers 366. The triggers 366 can be rotated by the vertical movement of the actuation link 362 which in turn lowers the rotational compensation links 364 which are connected to the trigger arms 366. The trigger arms 366 are held against the brake actuator shafts 320 with the end of the trigger arm fitting into the grooves 324 machined in the upper faces of the actuator shafts 320. When the triggers 366 press into the grooves 324 in the actuator shafts 320, the brakes are held in the 'off' position.

The other end of the trigger actuation link 362 is connected to the solenoids 368. The solenoids 368 support the trigger actuation link 362 at a constant position when electric power is supplied, and release the trigger actuation link 362 when the electric power supply is switched off for a brake application or when the power fails. When the solenoids 368 are switched off, the trigger actuation link 362 moves downwards and the rotational compensation links 364 rotate to a predetermined angle, thereby the trigger 366 is released from the retaining groove 324 in the brake actuator shaft 320.

The whole brake trigger unit is designated 360. The solenoid trigger units 368 are connected to the lower end of the single trigger actuation link 362. A pair of rotational compensation links 364 are joined to the upper end of the trigger actuation link 362 thereof. The solenoids 368 are redundant and failure monitored by the vehicle control system. The reason to install a pair of solenoids 368 is to prevent an abnormal condition due to malfunction of any one of the solenoids 368. In other words, even though only one solenoid 368 is working it can operate the trigger actuation link 362 to release both triggers 366 which releases both the actuator shafts 320, respectively. The reason to apply the solenoids 368 to the trigger unit 360 is to make the brakes 300 actuate immediately without any additional control commands in the event that the electric power supply is cut off.

Spring members 370 are installed in the inside of the support frame 310 to which inner ends of the spring members 370 are connected, and the other ends of the spring members 370 are connected to the actuator shafts 320. The spring members 370 are normally held in tension when the brake is off and elastically power the actuator shafts 320, making the actuator shafts 320 move in towards each other if the actuator shafts 320 held by the trigger units 360 are released. In the case that the power supply is cut off, the spring members 370 provide dynamic force so that the brakes 300 work. The spring members 370, being under tension in the extended state, put pressure on the actuator shafts 320 held by the triggers 366, and move the actuator shafts 320 towards each other as soon as the trigger 366 is released. At this time, the spring members 370 are retracted and the brakes 300 are actuated.

A brake releasing unit 380 is installed on the support frame 310. The brake releasing unit 380 is equipped with two redundant electric motors 382 which are failure monitored by the vehicle's control computer, and connected to the actuator shafts by gear trains 384 composed of a plurality of gears 385, and pinions 386. The pinions 386 are engaged with the racks 322 of the actuator shafts 320 and connected to the gear trains 384. The brake releasing unit 380 is designed to release a brake 'on' state by moving the actuator shafts 320 outward to the reset position. The gear trains are intermeshed so that either motor can operate the brake release mechanism. That is, when only one motor 382 operates, both of the brake releasing units 380 are actuated. This arrangement is intended to circumvent malfunction of the motor 382 in one brake releasing unit 380.

Figure 2:
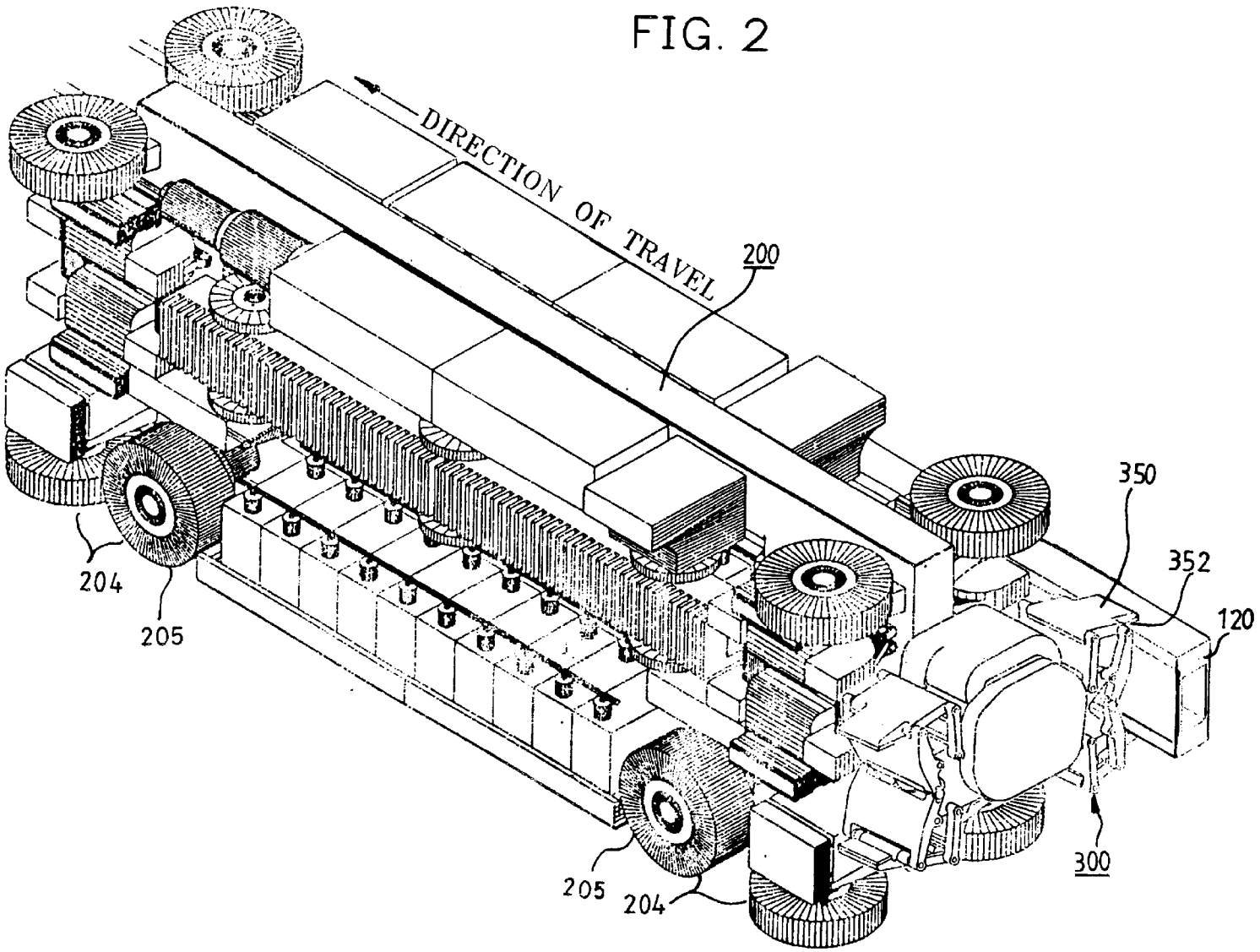
FIG. 2 is a perspective view of the vehicle chassis on which the FIG. 1 brakes are mounted.

FIG. 2 is a perspective view of the vehicle chassis on which the brake shown in FIG. 1 is mounted. As shown, a plurality of wheels for supporting 205 and guiding 204 the vehicle chassis 200 are installed on the vehicle chassis 200. The brakes 300 as shown in FIG. 2 are mounted at the rear of the chassis 200, and the brake reaction rails 120 which are mounted on the guideway 100 (not shown for clarity) are located on each side of the chassis 200. During brake operation, each pair of brake arms 350 opposite to each other clamp onto the upper and lower surfaces of the brake reaction rails 120 acting as calipers. The brake arms 350 include brake pads 352 which contact the top and bottom sides of the brake reaction rails 120 during the braking operation.

In order to prevent any possible overturning moment or lifting of the rear wheels 205 from the guideway surface during heavy emergency braking, the actuator shafts 320 of the brakes should be designed to pass through or close to the center of gravity of the vehicle chassis and the brake should be located at the rear of the chassis 200.

Figure 3A:
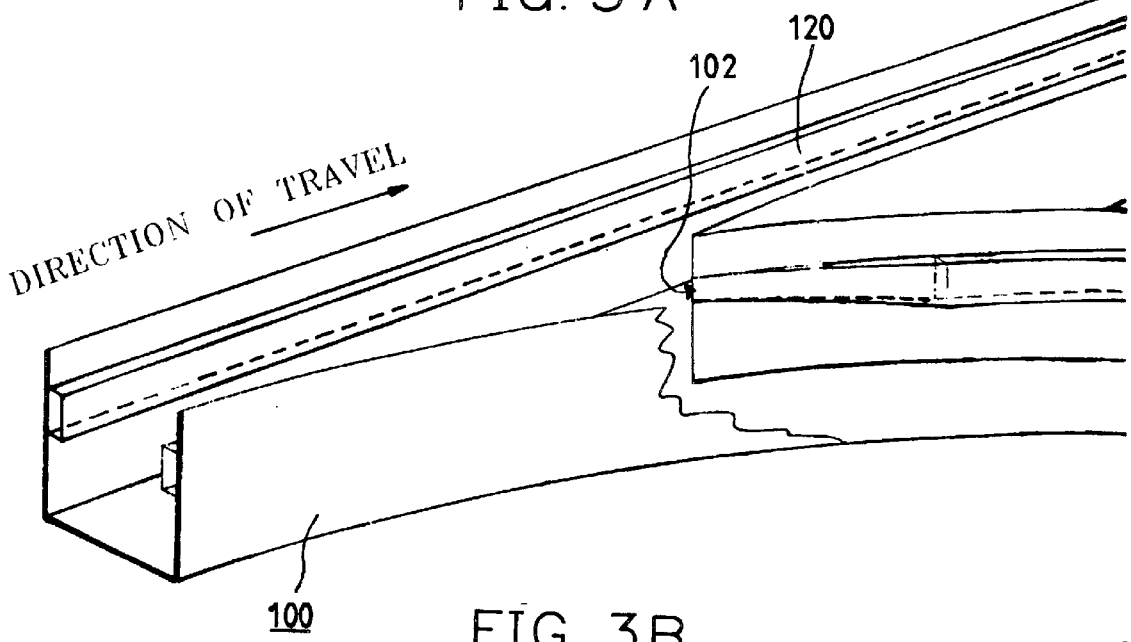
FIGS. 3A and 3B are views showing brake reaction rails on the guideway at diverge switch and merge switch.
Figure 3B:
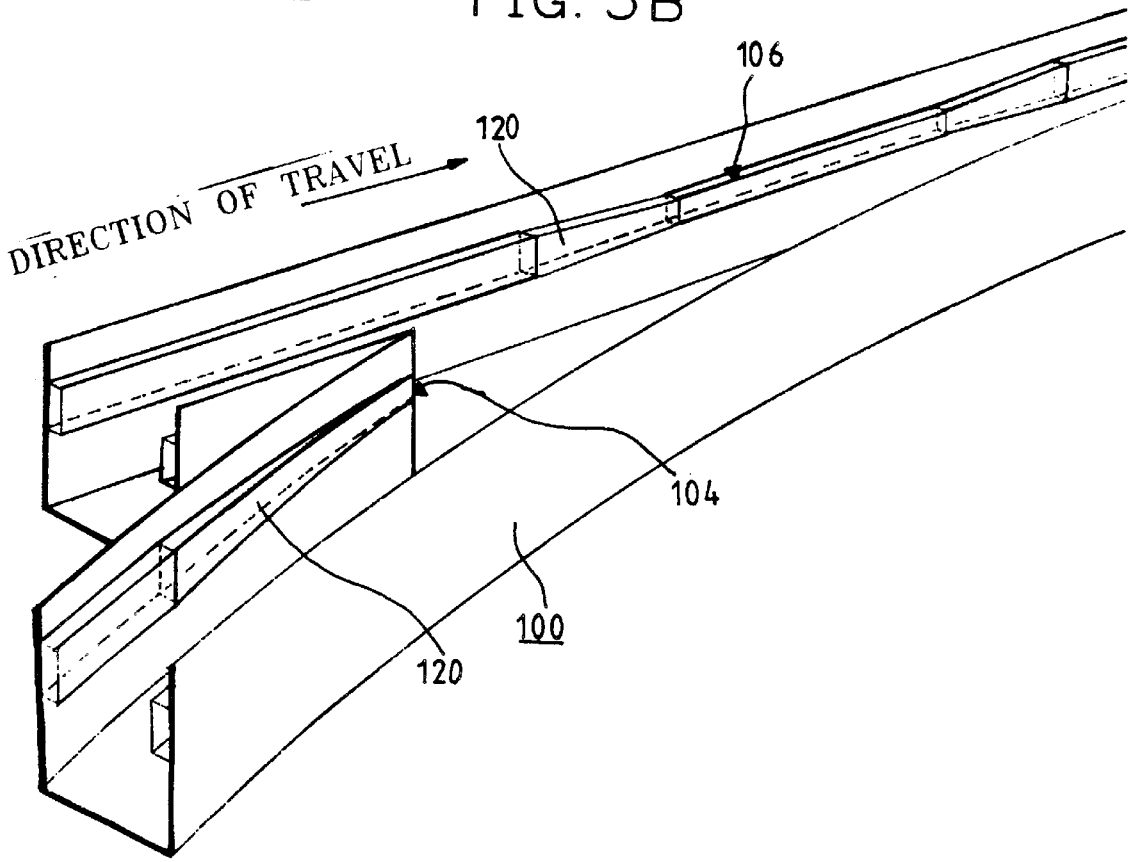

FIG. 3A shows the brake reaction rail 120 in the guideway at the diverge point of a switch 102 and FIG. 3B shows the brake reaction rail 120 in the guideway at the merge point of a switch 104. When the guideway 100 is diverged as shown in FIG. 3A, the brake reaction rail 120 located at the diverge switch point 102 is tapered to permit smooth transitions in the event that the vehicle is applying emergency brakes as it passes through the switch. When the guideway 100 is merged as shown in FIG. 3B, the brake reaction rail 120 is tapered at the merge point 104, and the brake reaction rail 120 on the re-engagement side 106 is also tapered. The reason that the brake rails 120 are tapered at diverge or merge switch points is to allow the brake arms a smooth disengagement and engagement with the brake rails 120 in the event that the vehicle is undergoing emergency braking in a switch section and the brake arms 350 are in the 'on' position.

Figure 4A:
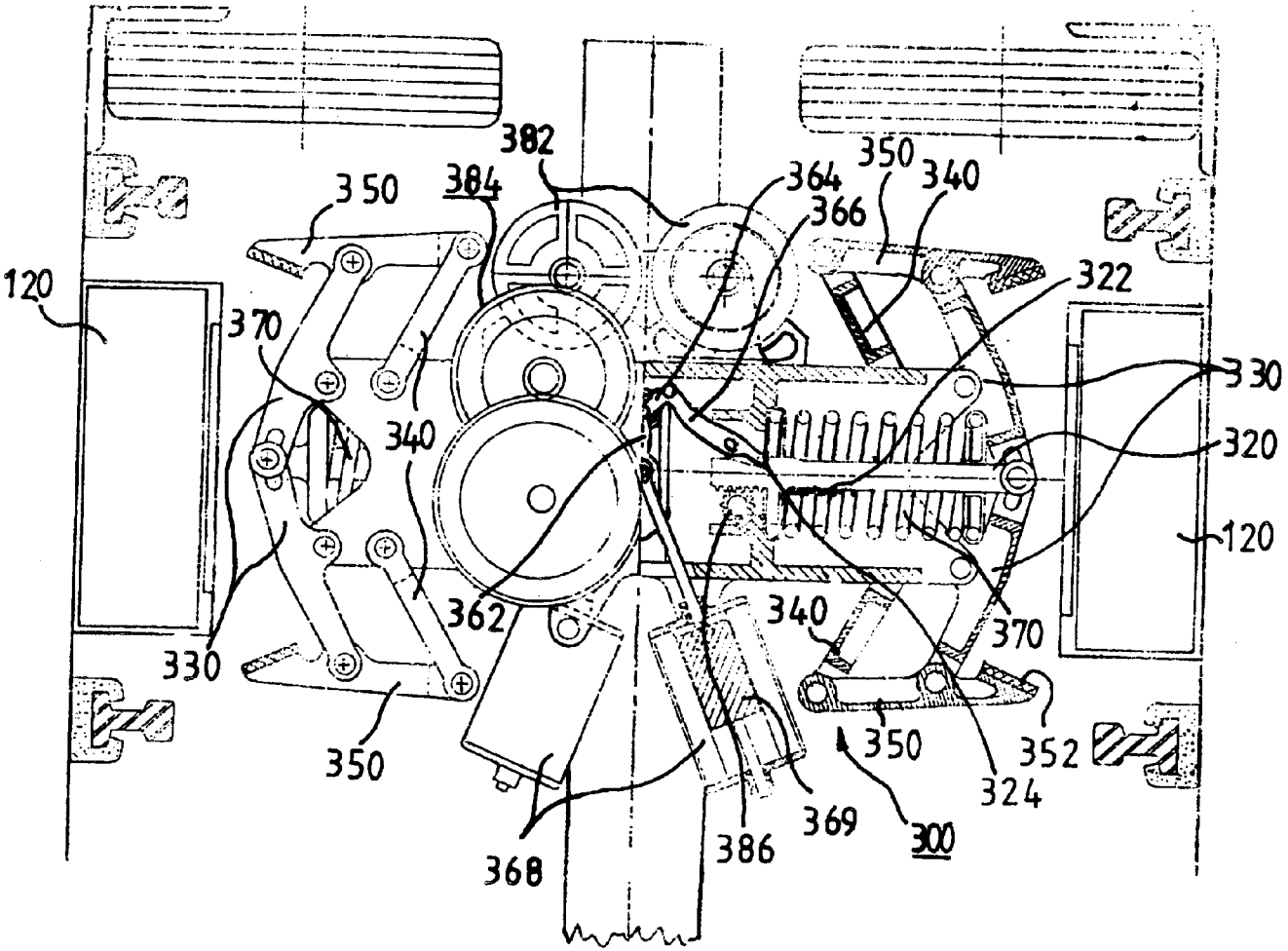
FIGS. 4A and 4B are views illustrating the operation of the FIG. 1 brake.
Figure 4B:
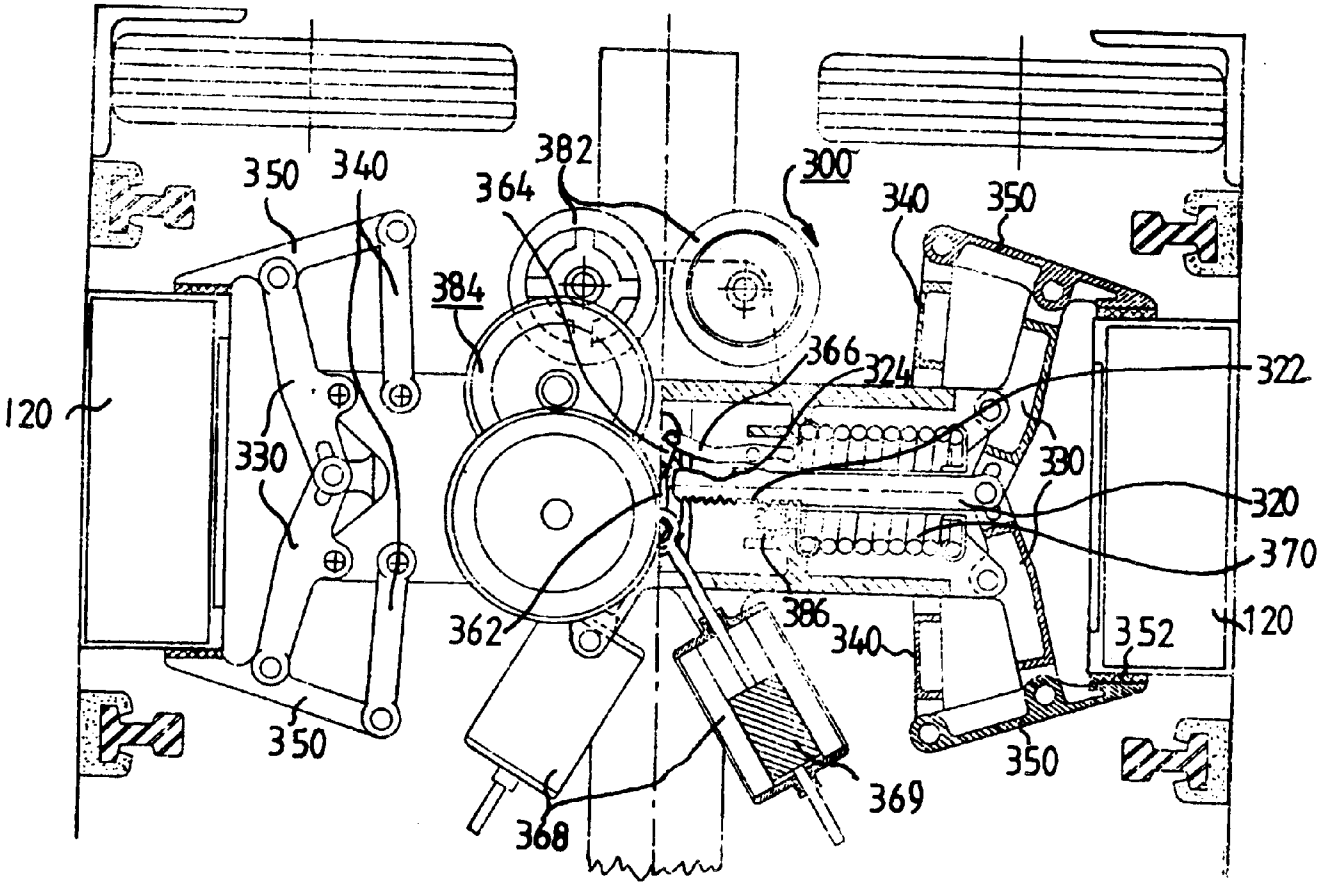

FIGS. 4A and 4B are views illustrating the operating process brake shown in FIG. 1. FIG. 4A shows the brake being in the 'off' position and FIG. 4B shows the brake being in the 'on' position. As shown in FIG. 4A, when the electric power to the solenoids 368 supporting the trigger actuation link 362 is switched off, a plunger 369 moves down as shown in FIG. 4B. The trigger actuation link 362 moves down, and at the same time the rotational compensation link 364 rotates at a certain angle as it moves down and the trigger 366 is pulled upwards. Accordingly, the end of the trigger 366 which is keyed into the groove 324 in the actuator shaft 320 is released from the groove 324. That is, the actuator shafts 320 are released, and retraction of the spring member 370 causes the actuator shafts 320 be driven inwards. With the actuator shafts 320 driven inwards, the links 330 and 340 rotate and the brake arms 350 set opposite to each other move outward toward the brake reaction rails 120. The length of the links 330 and 340 are designed unequally so that as they rotate the brake arms 320 are tilted towards each other while moving outwards towards the brake reaction rails. This is shown distinctly by comparison between FIG. 4A and FIG. 4B. When the brake actuator shaft 320 has moved inwards by its full travel distance and the first and second links 330 and 340 are rotated completely, the brake arms 350 clamp onto the brake reaction rails 120 as calipers as shown in FIG. 4B. As the brake pads 352 attached to ends of the brake arms 350 make contact with the upper and lower surfaces of the brake reaction rails 120, as shown in FIG. 4B, the braking operation of the brake 300 is completed.

When the triggers are released the brakes are applied by the strain energy stored in the springs 370. The rack gears 322 on the brake actuator shafts 320 drive the pinions 386 which in turn drive the gear train 384 and the motors 382. The rotational inertia of the electric motors 382 and the gear train 384 act to slow the braking action down so that the brake application is made smoothly in about 0.50 second. Since the braking action is symmetrical all forces are balanced out. This avoids jerks and unnecessary shock to the vehicle and brake components.

Figure 5A:
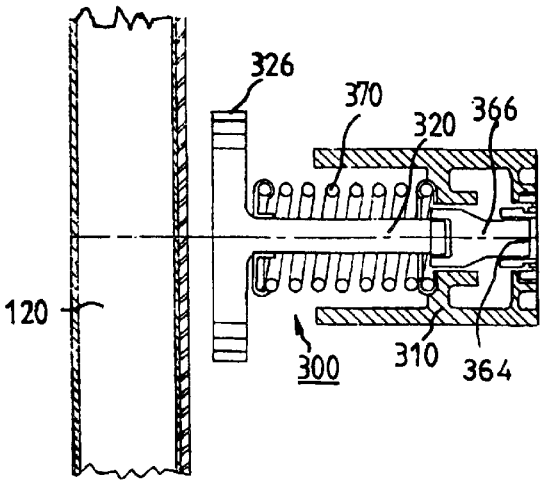
FIGS. 5A and 5B are plan cross-sectional views showing the triggers and brake actuator shafts.
Figure 5B:
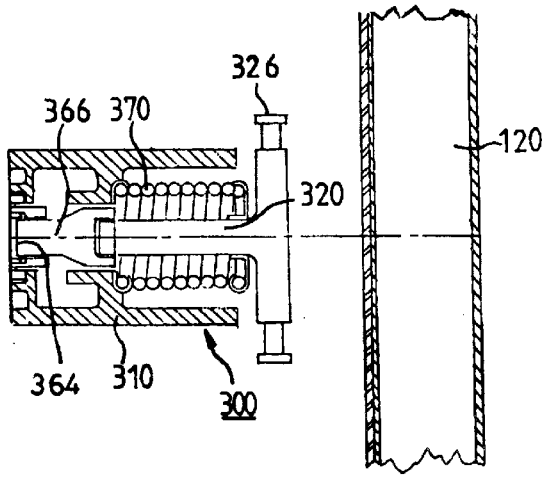

FIGS. 5A and 5B are plan cross-sectional views showing the triggers and the actuator shafts, in which FIG. 5A shows the brake in the 'off' position and FIG. 5B shows the brake in the 'on' position.

As shown in FIGS. 5A and 5B, the inner ends of the spring members 370 are fixed to the support frame 310, and the other ends of the springs thereof are connected to the actuator shafts 320. The ends of the actuator shafts 320 are connected to the brake actuator links 330 (not shown for clarity) by pinned joints 326. The actuator shafts 320 are held in the brake 'off' position by the triggers 366. Here, FIG. 5A shows that the actuator shafts 320 are held by the triggers 366 and FIG. 5B shows that the actuator shafts 320 are released from the triggers 366 and have been pulled inwards by the springs 370. When the actuator shafts 320 are held in the 'off' position by the trigger 366, the spring member 370 is stretched in an extended state as shown in FIG. 5A. In the event that the actuator shafts 320 are released to apply the brakes, the spring member 370 contracts to a retracted state as shown in FIG. 5B. The brake rails 120 are aligned at the lateral sides of the brake 300.

Figure 6:
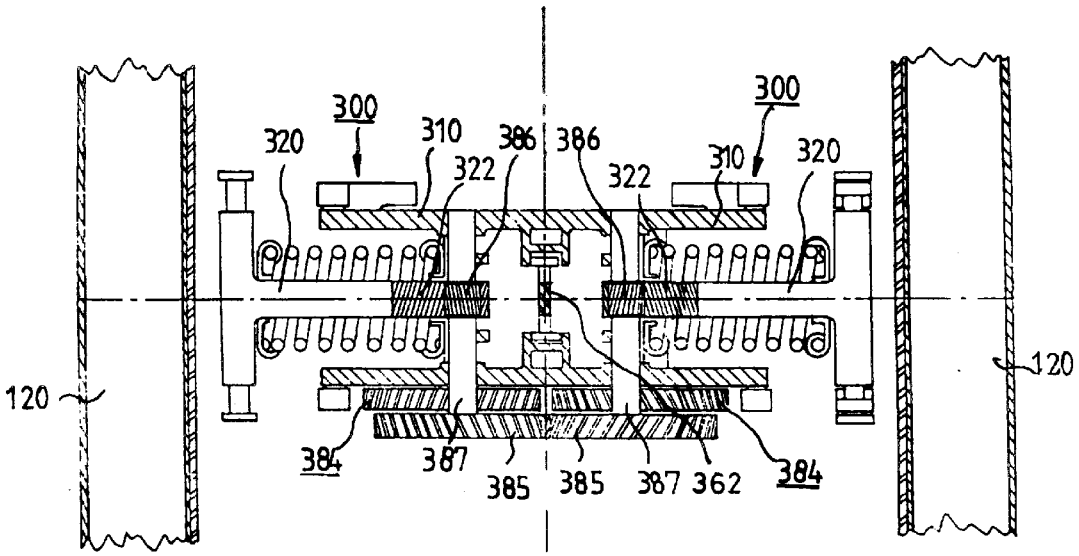
FIG. 6 is a bottom view showing the triggers and brake actuator shafts.

FIG. 6 is a bottom view showing the actuator shafts 320, the rack 322 and pinion 386 gearing which drives the actuator shaft 320, the gear wheels 384 and 385 which are driven by the brake release motors 382 (not shown). The drawing indicates the brakes in the 'off' position. As shown in FIG. 6, the rack gears 322 are machined on the under sides of the actuator shafts 320 with which the pinion gear wheels 386 are engaged. The pinions 386 are mounted on axles 387 which are connected to the first gear wheel of the gear train 384. The axles 387 are installed in bearings on the support frame 310. Both of the gear trains 384 are interlinked with each other by a pair of gears 385 mounted on the axles 387. When one side of the gear trains 384 is driven, the other gear train 384 is also driven. This means that actuation of one drive motor 382 will ensure that both brakes are released. The brake reaction rails 120 are shown aligned at the right and left sides of the brakes 300.

Figure 7B:
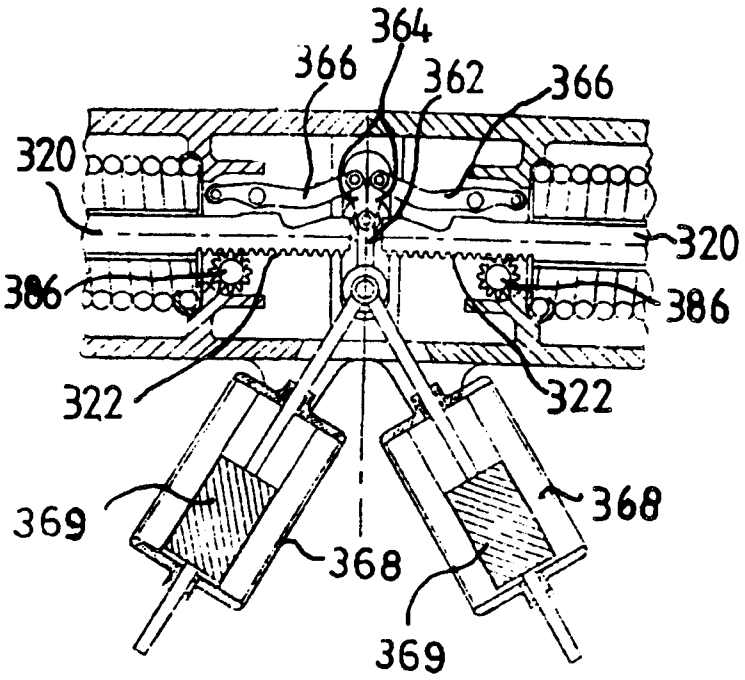
FIGS. 7A and 7B are lateral cross-sectional views showing the location of the rack and pinion sections of the actuator shafts and triggers in the 'off' (7A) and 'on' (7B) brake positions.
Figure 7A:
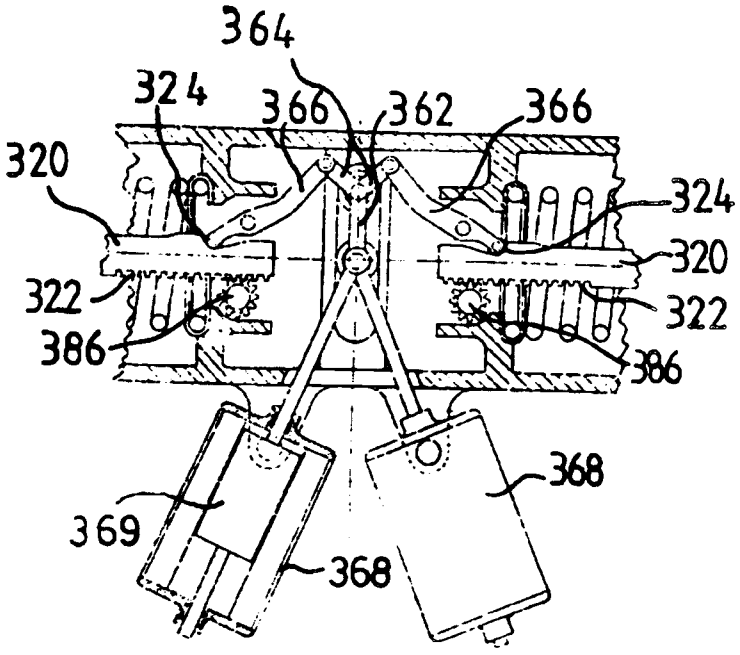

FIGS. 7A and 7B are lateral cross-sectional views showing the locations of the rack and pinion drive units in the brake 'on' and 'off' positions. FIG.7A shows the brake 'off' position and FIG.7B shows the brake 'on' position. In FIG. 7A, the solenoids 368 are connected to the trigger actuation link 362, which slides up and down in a track guided by roller bearings. The trigger actuation link 362 is connected to the rotational compensation links 364 which are pin jointed to the triggers 366. One end of the trigger 366 is inserted into the trigger key groove 324 which is machined into the actuator shafts 320 to thereby hold the actuator shafts 320 in position. The racks gears 322 machined on the undersides of the of the actuator shafts 320 are engaged to the pinions 386. FIG. 7B shows the condition where the solenoids 368 are switched off and the solenoid plungers 369 move down to release the trigger actuation link 362. Accordingly, the trigger actuation link 362 moves down and the triggers 366 are released.

Figure 8B:
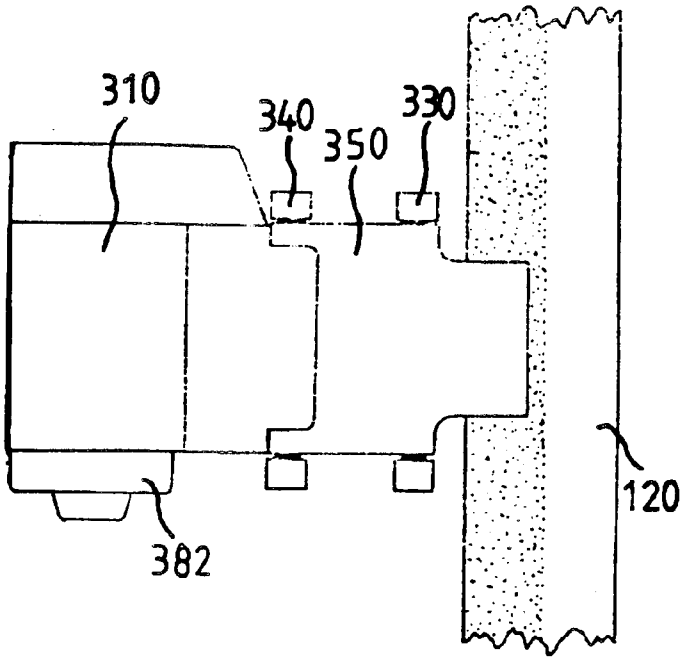
FIGS. 8A and 8B are top plan views in half sections showing the brakes; brake 'off' (8A); brake 'on' (8B).
Figure 8A:
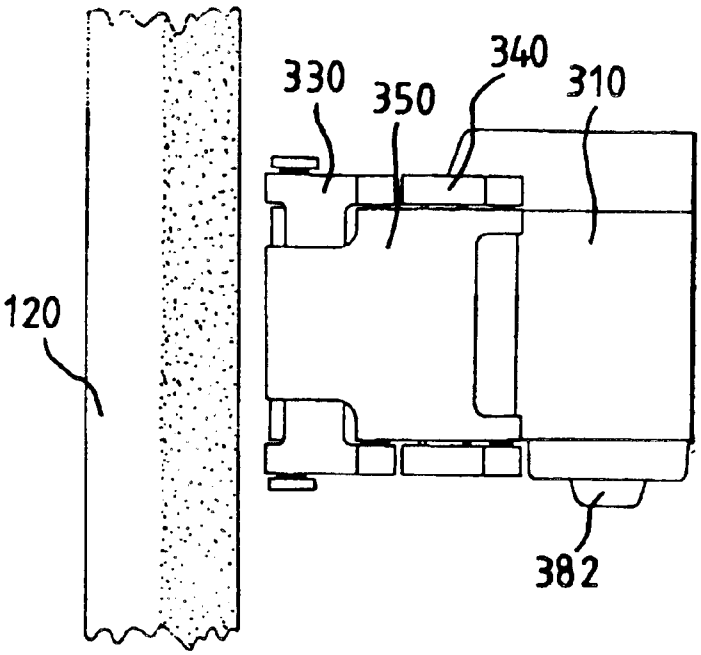

FIGS. 8A and 8B are top plan views in half section showing how the brake arms 350 act on the brake reaction rails 120. FIG. 8A shows the brake 'off' position and FIG. 8B shows the brake 'on' position. In FIG. 8A, one of the electric motors 382 for brake release is shown installed in the center of the support frame 310. The brake arm 350 which is connected to the first links 330 and the second links 340, is installed in the support frame 310. The brake arm 350 is held out of contact with the brake rail 120 when the vehicles are moving and is only normally used when the vehicle is stopped at a station or parked on the line. FIG. 8B shows the support frame 310, the motor 382 for brake release, the brake arm 350, the first links 330 and second links 340. The first and second links 330 and 340 are shown fully extended when the brake is applied, the brake arm 350 is then forced into contact with the brake reaction rail 120. The braking operation is then completed.

Figure 9B:
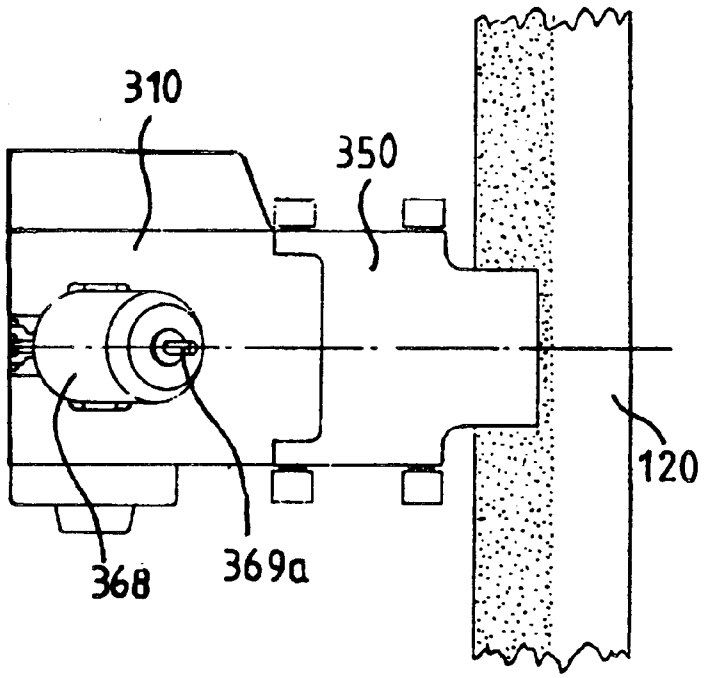
FIGS. 9A and 9B are bottom views in half sections showing the brakes; brake 'off' (9A); brake 'on' (9B).
Figure 9A:
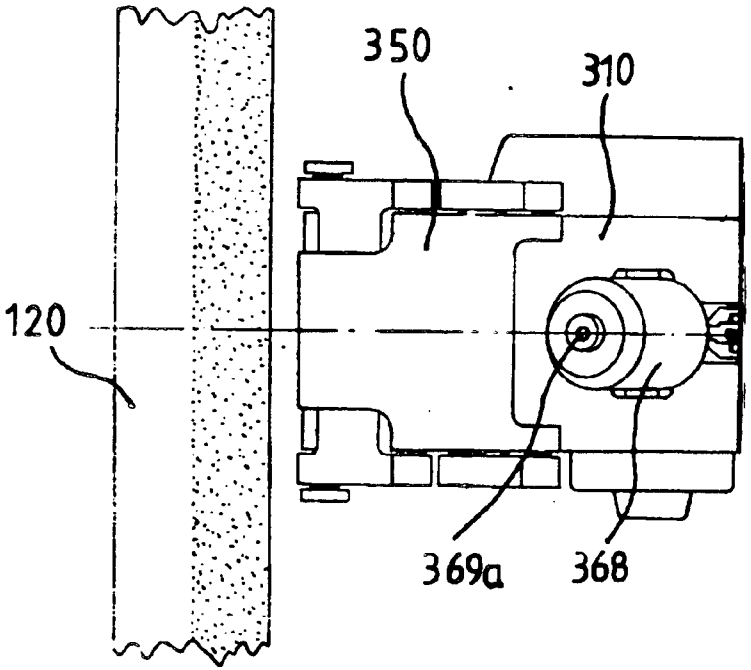

FIGS. 9A and 9B are bottom views in half section showing how the brake arms 350 act on the brake reaction rails 120. FIG.9A shows the brake 'off' position and FIG.9B shows the brake 'on' position. As can be seen from FIGS.9A and 9B, the solenoids 368 are attached by pinned joints to the bottom surface of the support frame 310 so that they can swivel slightly. The solenoid 368 of FIG. 9A supports the trigger actuation link 362 (not shown) in the locked position and that of FIG. 9B shows the solenoid in the released position of the trigger actuation link 362. The trigger actuation link has moved down and the solenoid actuator has also dropped down. FIG. 9A shows the brake arm 350 retracted from the brake reaction rail 120, and FIG.9B shows the brake arm acting on the brake reaction rail 120.

Figure 10B:
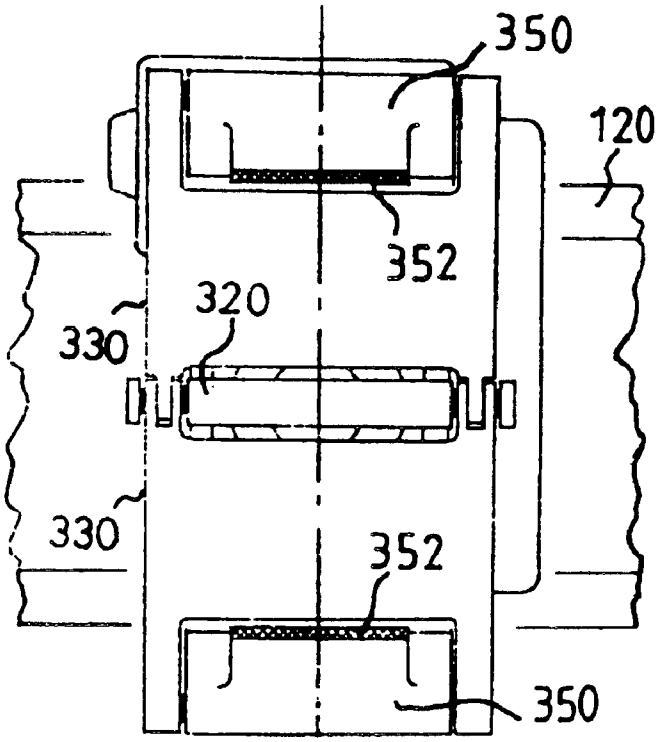
FIGS. 10A and 10B are plan elevational views showing the brake arms; brake 'off' (10A); brake 'on' (10B).
Figure 10A:
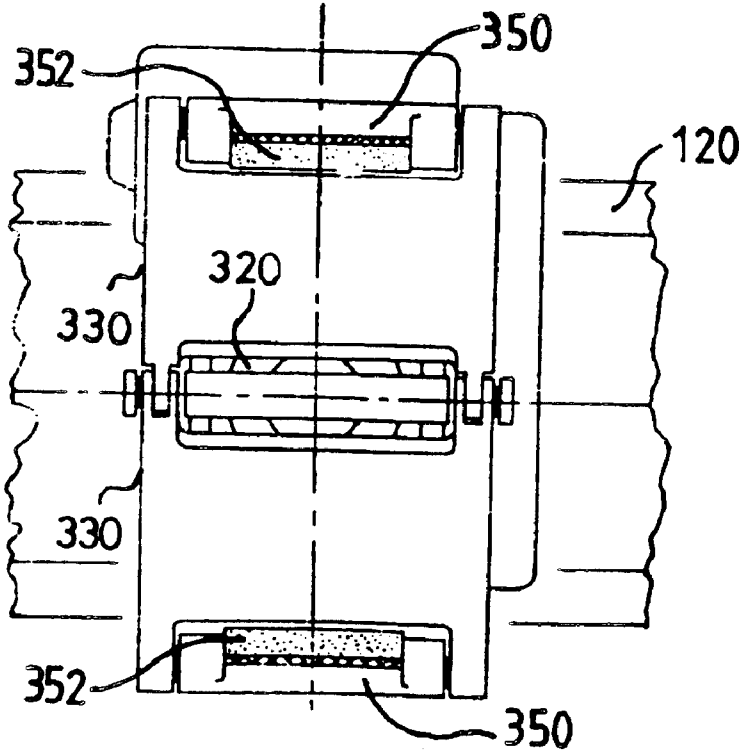

FIGS. 10A and 10B are side elevation views showing the braking arms 350 and links 330 in relation to the brake reaction rail 120. FIG. 10A shows the brake 'off' position and FIG. 10B shows the brake 'on' position. In FIG. 10A, a pair of top and bottom brake arms 350 are in the 'off' position so that their brake pads at the front ends open wider than the brake reaction rail shown in the background. The contact surfaces of the brake pads 352 are shown in the front. In FIG. 10B, a pair of top and bottom brake arms 350 are shown on the 'on' position so that the brake pads 352 contact the surfaces of the brake reaction rail 120. The contact surfaces of the brake pads 352 are contact with the upper and lower surfaces of the brake reaction rail 120, respectively. The cross arm of the brake actuator rod 320 is also shown.

Figure 11:
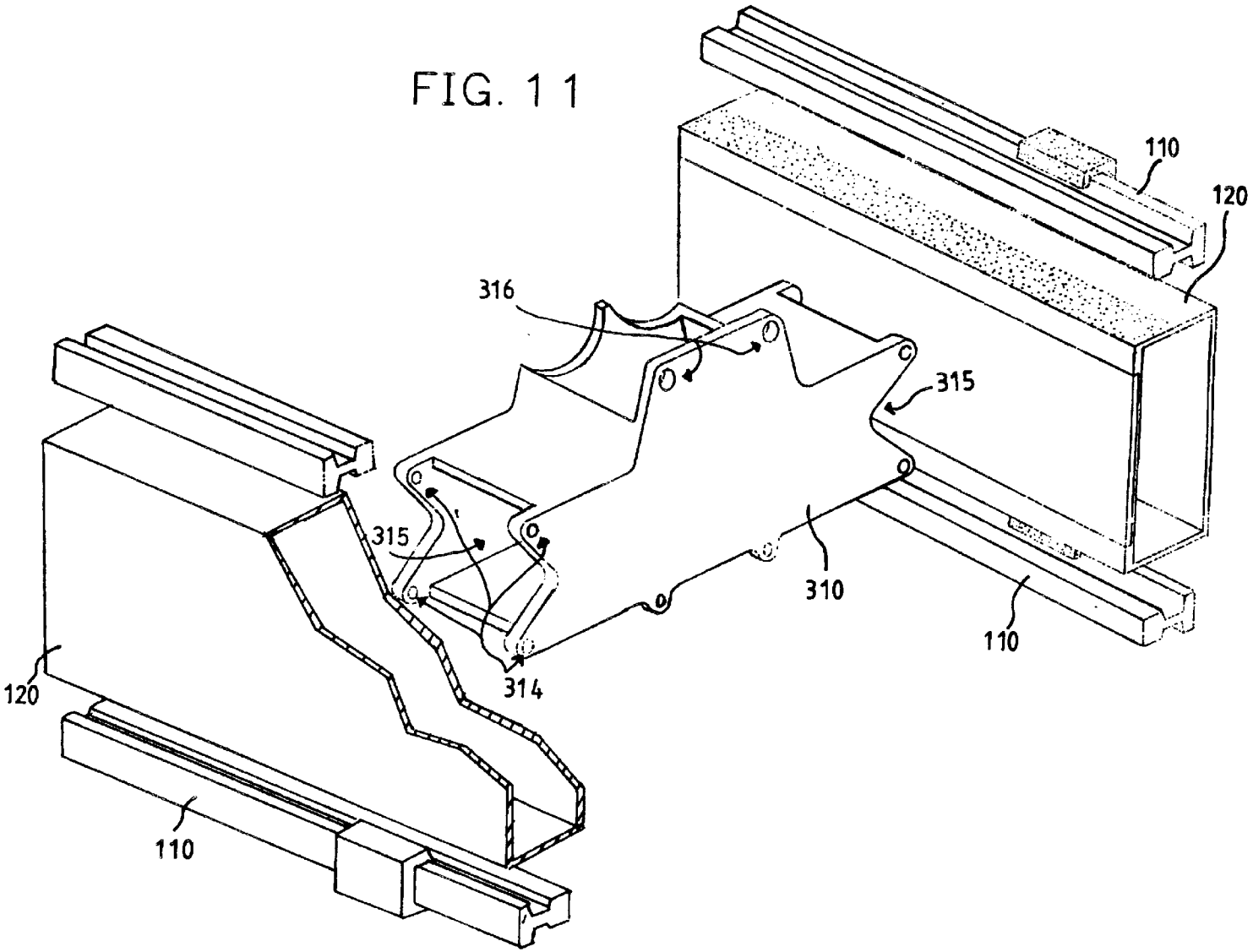
FIG. 11 is a perspective view showing a brake support frame configured in relation to the brake reaction rails and electric power supply rails.

FIG. 11 is a perspective view showing the brake support frame 310 configured in relation to the brake reaction rails 120 and the electric power supply rails 110. The brake reaction rails 120 are parallel to each other and aligned at a constant separation interval. At the top and bottom of the brake reaction rails 120, the electric power supply rails 110 are installed at a constant separation interval. The brake frame 310 is installed on the chassis so as to be positioned centrally between two brake reaction rails 120.

As shown the support frame 310 is an approximately hexahedron shape and has mounting bearing points 314, 315 and 316 at right, left and top for the various brake fittings. A pair of motors 382 will be installed at the top opening 316. The brake arm 350 support linkages 330 and 340 are mounted in the bearings 314. The brake actuator shafts are mounted on both sides at position 315.

Figure 12:
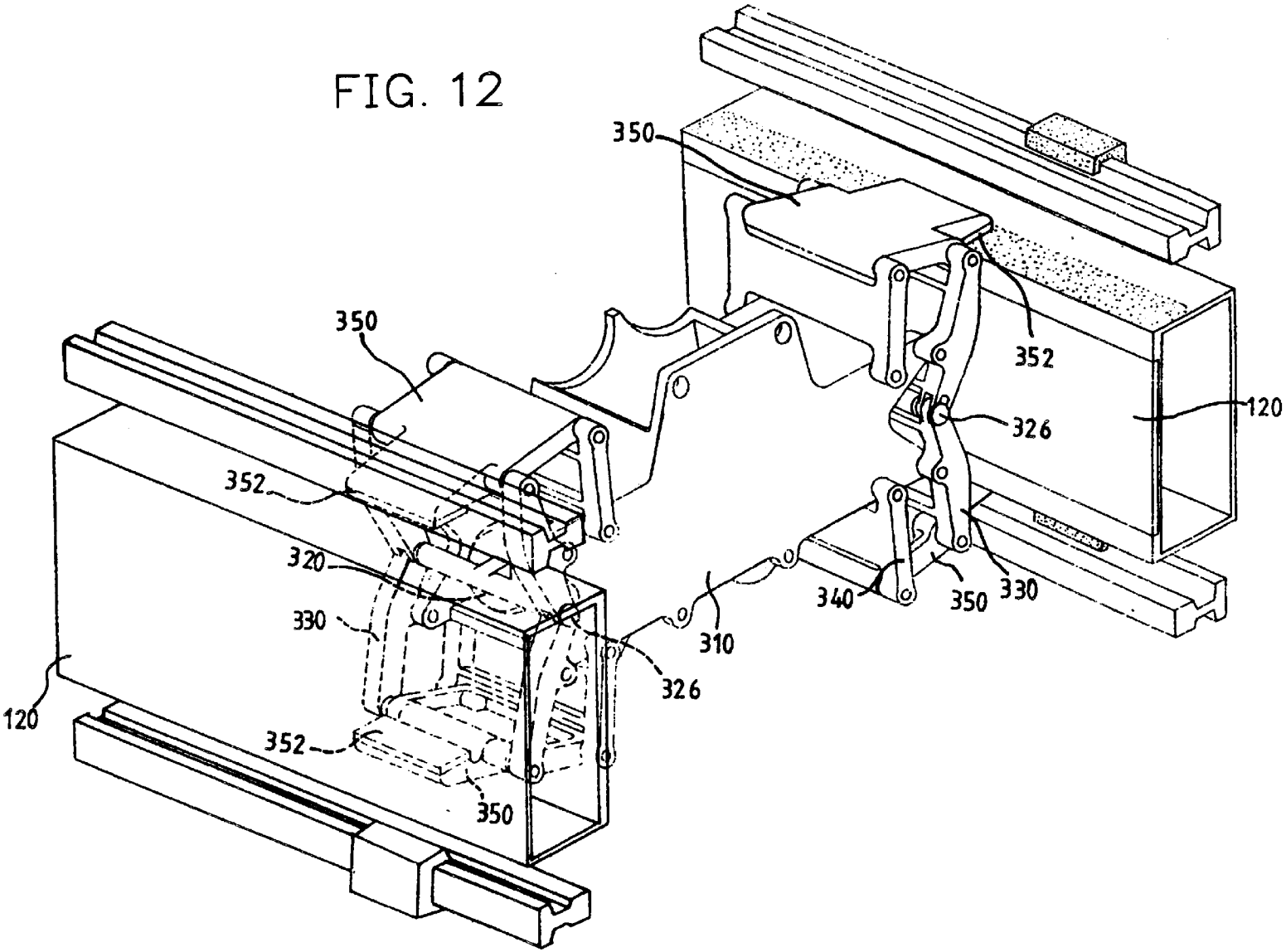
FIG. 12 is a view showing that the support frame in FIG. 11 is equipped with brake arms and link units.

FIG. 12 is a perspective view showing the brake support frame of FIG. 11 equipped with the brake arms 350 and the link units 330 and 340. As shown in FIG. 12, around right, left and top openings of the support frame 310, the first links 330 and the second links 340 are rotatably installed at the circumferential surfaces. The first links 330 are connected to the ends of the brake actuator rods 326 installed at the ends of the brake actuator shafts 320. Such first links 330 and second links 340 opposite to each other are connected with a pair of the brake arms 350. The brake pads 352 are attached to the brake arms 350, respectively.

Figure 13:
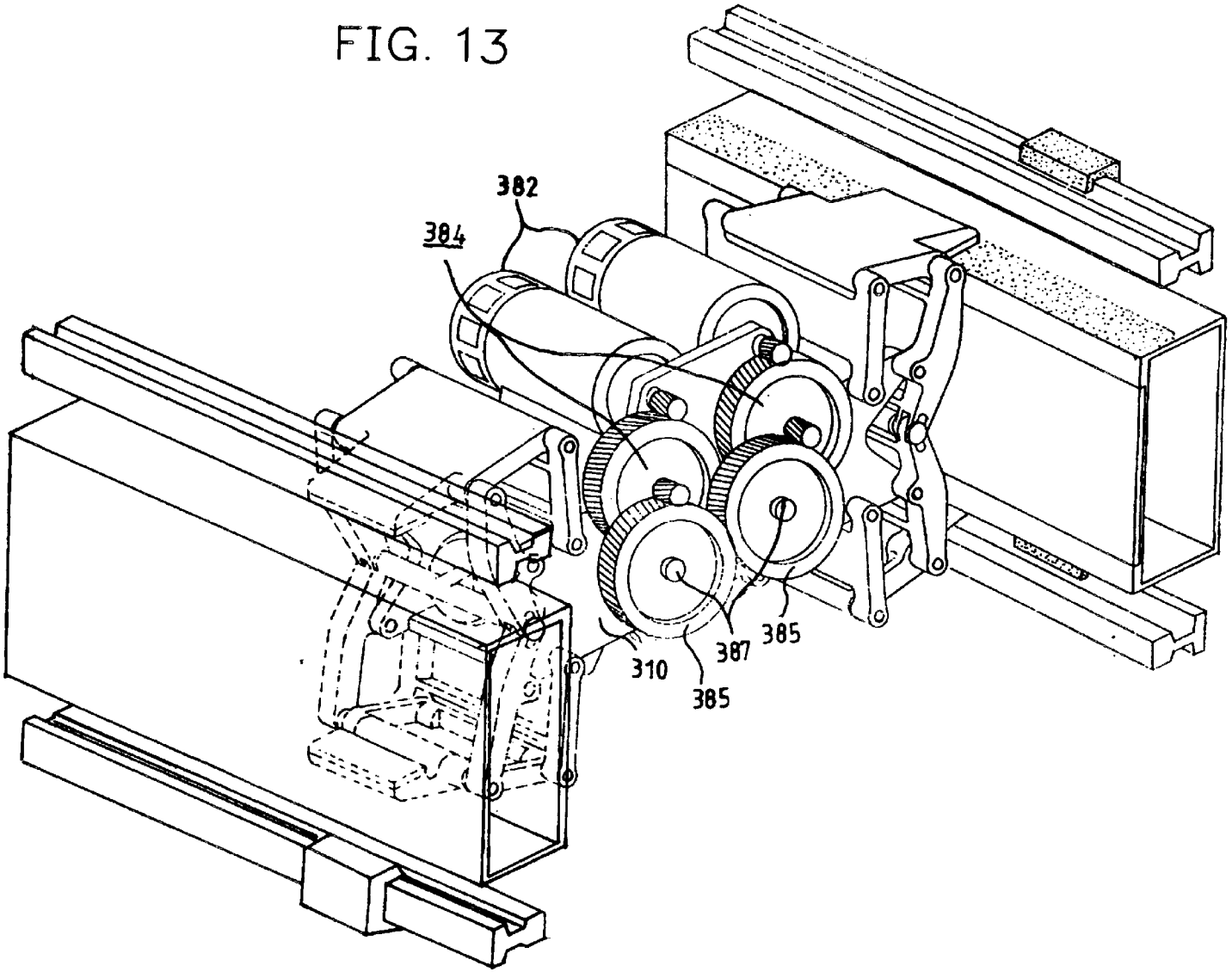
FIG. 13 is a view showing the additional installation of motors and gear trains in FIG. 12.

As shown in FIG. 12, if the brake actuator shafts 320 are moved forward and backward, each link of the first links 330 connected to the brake actuator rods 326 is rotated in the respective directions, and thus each of the second links 340 connected to the first links 330 via the brake arms 350 is also rotated in the respective directions. A pair of brake arms 350 disposed opposite to each other hold or release the brake reaction rails 120 according to the inward or outward movement of the brake actuator shaft FIG. 13 is a view showing the additional installation of the brake release motors 382 and actuation gears 384 and 385 of the gear trains in FIG. 12. A pair of redundant, failure monitored, motors 382 to which a pair of interlinked gear trains 384 composed of a plurality of gears are respectively connected, are mounted on the upper surface of the brake support frame 310. The gear trains 384 reduce the speed and increase the mechanical advantage of the motors 382 so that they are strong enough to stretch the brake actuator springs 370 to the brake 'off' position. That is to say, the motors 382 and the gear trains 384 are only intended to release the brakes.

As shown in FIG. 13, each of the right and left gear trains is interconnected by a pair of adjacent meshed gears 385. This allows the brakes to be released by only one motor of a pair of motors 382. This design ensure redundancy in the event of failure by one brake release motor. The failed motor will simply be rotated by the gear train operated by the good motor. The motors will be failure monitored and any failure of a motor will cause the vehicle to be returned to the maintenance depot.

Figure 14:
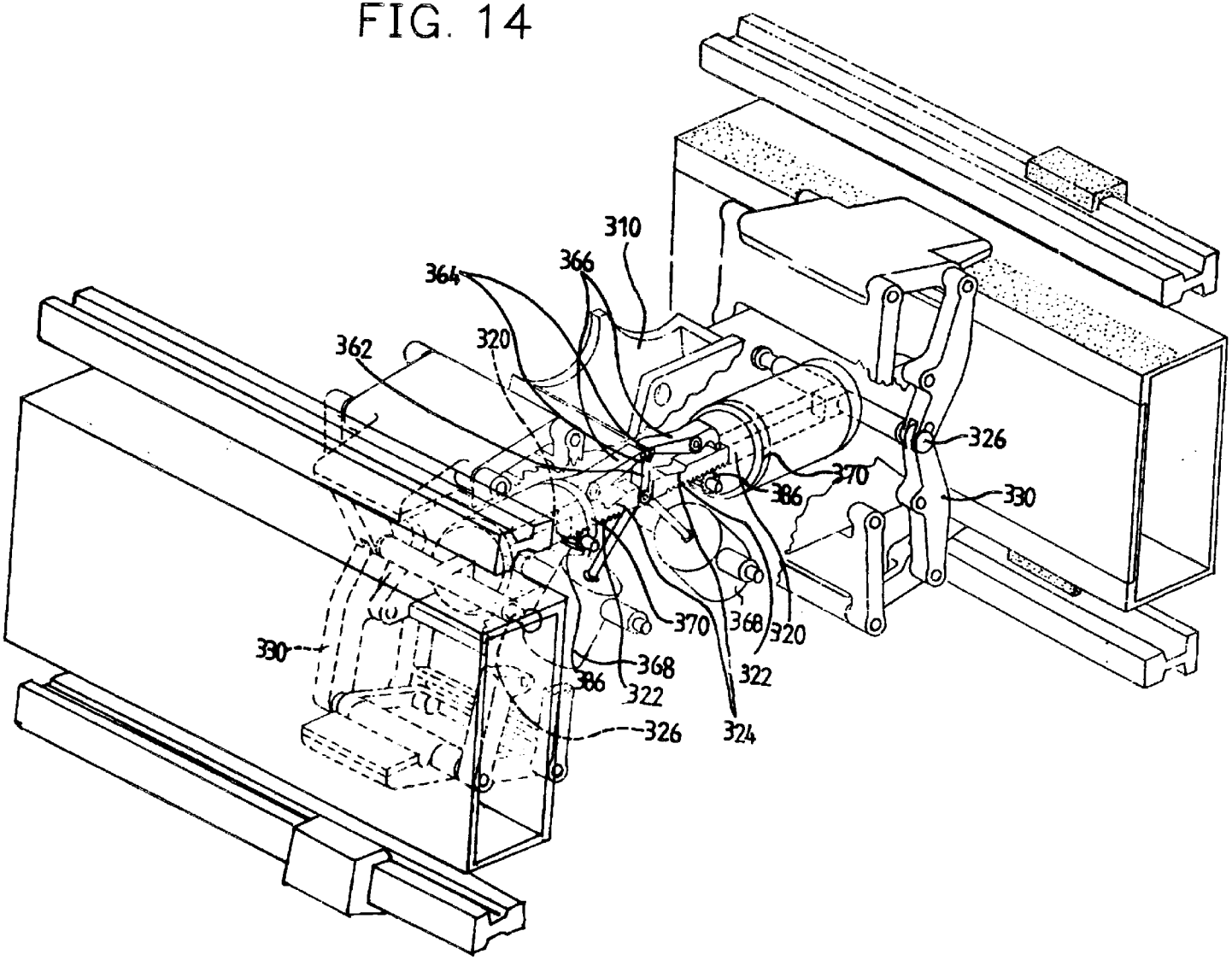
FIG. 14 is a view showing spring members, triggers and the trigger release solenoids

FIG. 14 is a view showing the steel actuator springs 370, triggers 366 and solenoids 368 installed inside the brake support frame. As shown in FIG. 14, a pair of brake actuator shafts 320 are disposed opposite to each other inside the support frame 310. The rack gears 322 are shown on the lower surface of the actuator shafts 320, and the trigger grooves 324 are shown on the upper surface of the actuator shafts 320. The driving pinions 386 are engaged with the rack gears 322, and the triggers 366 are disposed on the top of the groove 324. The triggers 366 are connected to the trigger actuation link 362 via a pair of rotational compensation links 364. The trigger actuation link 362 is connected to a pair of solenoids 368, with either one of which both of the triggers 366 can be actuated. The reason to use the solenoids 368 as the drive means for the trigger is to perform the braking operation immediately without requiring any control commands in the event that the electric power is cut off.

Industrial Applicability

As described above, the PRT braking system in accordance with the present invention provides high performance deceleration in excess of 2.00G (approximately 20 m/sec2) under all weather conditions during emergency braking of vehicles in action maintaining very short headways. Such high braking rates are made possible because the brake arms of the brake act as calipers on the brake rails. Also, primary operating components are duplicated and interlocked so that the failure of one component does not prevent the other redundant component from operating the brakes. For instance, the redundant components include two motors, two actuator shafts, two interlocked gear trains, two spring members, two triggers, two interlocked solenoids, brake pads on top and bottom of the brake rail, and brake reaction rails on each side of the guideway. The PRT braking system of the present invention is powered by strong steel spring members and requires no external power source for its operation. Furthermore, the system provides high reliability since it is actuated immediately without any control commands when the power supply is cut off. Accordingly, the PRT braking system of the present invention is suitable for a high reliability parking or emergency braking system and to provide good braking performance.

What is claimed is:

1. A braking system for personal rapid transit equipped with a guideway (100) disposed along a predetermined path and vehicles installed to travel along the guideway (100), the brake system comprising:

brake reaction rails (120) aligned along each of the inside walls of the said guideway (100) and continuously along the walls of the guideway switch sections;

actuator shafts (320) movably installed at each side of the vehicle normal to the axial direction;

link units, disposed opposite to each other being connected to said actuator shafts (320) and composed of pairs of links, for rotating at the re-set position to a predetermined angle in the reverse direction according to whether said actuator shafts (320) move forward or backward;

a pair of brake arms (350), connected to each pair of said links and installed in a caliper arrangement so that the position and clearance of the lateral ends thereof can be varied according to a rotational angle of said links, for providing the braking force contacting with each of said brake rails (120) at a constant rotational angle of said links;

a trigger unit (360) for holding the said actuator shafts (320) at a constant position or releasing the actuator shafts (320) when braking is necessary;

spring members (370) for elastically powering the said actuator shafts (320) held by the said trigger unit (360), and for moving said actuator shafts (320) in the predetermined direction to then provide power for the brake application when the actuator shafts (320) are released from the trigger unit (360); and brakes (300), including a brake releasing unit (380) driven through intermeshed gear trains by redundant electric motors which are failure monitored, for moving said actuator shafts (320) in the reverse direction as necessary to reset the brakes in the 'off' position.

2. The braking system for personal rapid transit as claimed in claim 1, wherein said brake reaction rails (120) are installed at a predetermined height, equivalent to the center of gravity of the vehicle chassis, opposite to each other along both lateral sides of said guideway (100) and are projected to the inside thereof, wherein the vehicle mounted brakes (300) are disposed opposite to each other so as to actuate on a pair of the brake rails (120) respectively.

3. The braking system for personal rapid transit as claimed in claim 2, wherein at a switch section of the guideway the said brake rails (120) are tapered in the horizontal and vertical directions at the point where said rails are diverged or merged to avoid any interference with the vehicle mounted brake arms (350) in the event that these have been actuated for emergency braking.

4. The braking system for personal rapid transit as claimed in claim 2, wherein the upper and lower surfaces of said brake rails (120) have roughened surfaces to increase coefficients of friction to the level required to achieve a braking deceleration rate of 20 m/sec$^2$.

5. The braking system for personal rapid transit as claimed in claim 2, wherein said brakes (300) are installed at the rear of said vehicle, and the center line of said actuator shaft (320) passes through the center of gravity of said vehicle's chassis, in such a manner as to prevent rotation of the vehicle during heavy emergency braking.

6. The braking system for personal rapid transit as claimed in claim 2, wherein a pair of said brakes (300) are integrally installed in a symmetrical support frame (310) which is in an approximately hexahedron form including mounting points (314, 315 and 316) at right, left and top surfaces thereof.

7. The braking system for personal rapid transit as claimed in claim 6, wherein said actuator shafts (320) comprise rack gears (322) for transmitting the torque of the brake releasing unit (380) pinion gears; and trigger grooves (324) which hold the said trigger units (360).

8. The braking system for personal rapid transit as claimed in claim 7, wherein said trigger unit (360) comprises a trigger actuation link (362) which is movably installed along a constant path formed at the inside of said support frame (310) in the direction perpendicular to said actuator shafts (320);

rotational compensation links (364) which are rotatably connected to the end of said trigger actuation link (362);

triggers (366), rotatably connected with said rotational links (364), for respectively holding the said brake actuator shafts (320) by being inserted into said groove (324);

and solenoids (368), connected to said trigger actuation link (362), for supporting the said straight movement link (362) at a pre-set position, and releasing the support for said trigger actuation link (362) so as to make said triggers (366) release from said groove (324) when the electric power supply to the solenoids is cut off.

9. The braking system for personal rapid transit as claimed in claim 8, wherein a pair of rotational links and a pair of solenoids (368) are connected to the same single trigger actuation link.

10. The braking system for personal rapid transit as claimed in claim 7, wherein said brake releasing unit comprises pinions (386) engaged with racks of said actuator shafts (320), a plurality of gear trains (384) for deceleration connected to said pinions (386), and redundant failure monitored motors (382) for supplying the power to said gear trains (384).

11. The braking system for personal rapid transit as claimed in claim 10, wherein a pair of said gear trains 384 are connected via a pair of meshed gears to achieve redundancy of the release mechanism.

12. The braking system for personal rapid transit as claimed in claim 6, wherein said link units, which are movably installed in said support frame (310), include a pair of first links (330) connected to said actuator shafts (320) and a pair of second links (340) joined with the pair of the first links (330) via said brake arms (350), wherein the pair of said second links (340) which are disposed apart at a predetermined interval from the pair of the first links (330) are movably installed in the brake reset position in the support frame (310), and the first links (330) and the second links (340) are arranged in an asymmetric quadrilateral shape.

13. The braking system for personal rapid transit as claimed in claim 12, wherein brake actuator rods (326) are horizontally and placed at the ends of the brake actuator shafts (320), wherein said brake actuator rods (326) are connected with two pairs of the first links at a predetermined interval.

14. The braking system for personal rapid transit as claimed in claim 13, wherein said brake arms (350) are in a plan plate shape having width as wide as the first links (330) are disposed, and said second links (340) are in a trapezoid shape.

15. The braking system for personal rapid transit as claimed in claim 6, wherein one end of said spring members (370) is connected to said support frame (310) and the other thereof is joined to said actuator shafts (320).

16. The braking system for personal rapid transit as claimed in claim 15, wherein said spring member (370) is composed of a steel coil spring having the elastic strain energy necessary to perform the braking operation, wherein the spring member (370) powers the said actuator shafts (320) under tension, but moves said actuator shafts (320) to a predetermined direction under retraction when said actuator shaft (320) is released from said triggers (366), to thereby provide the braking.

17. The braking system for personal rapid transit as claimed in claim 6, wherein the brake pads (352) are further installed at said brake arms (350) contacting with said brake reaction rails (120) which are roughened in order to increase the friction coefficient of the brake surfaces.

18. The braking system for personal rapid transit as claimed in claim 2, wherein the brake pads (352) are further installed at said brake arms (350) contacting with said brake reaction rails (120) which are roughened in order to increase the friction coefficient of the brake surfaces.

19. The braking system for personal rapid transit as claimed in claim 1, wherein brake pads (352) are further installed at said brake arms (350) contacting with said brake reaction rails (120) which are roughened in order to increase the friction coefficient of the brake surfaces.

20. The braking system for personal rapid transit as claimed in claim 19, wherein said brake pads (352) are made of a sintered carbon composite compound or an asbestos compound.

* * * * *